US010907229B2

(12) United States Patent
Kim et al.

(10) Patent No.: US 10,907,229 B2
(45) Date of Patent: Feb. 2, 2021

(54) HOT-WORK MOLD STEEL FOR DIE CASTING AND METHOD OF MANUFACTURING THE SAME

(71) Applicant: DOOSAN HEAVY INDUSTRIES & CONSTRUCTION CO., LTD., Changwon-si (KR)

(72) Inventors: Kuk Cheol Kim, Changwon-si (KR); Byoung Koo Kim, Changwon-si (KR); Jeong Wook Kim, Changwon-si (KR); Jae Suk Jeong, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 0 days.

(21) Appl. No.: 16/739,075

(22) Filed: Jan. 9, 2020

(65) Prior Publication Data

US 2020/0181724 A1 Jun. 11, 2020

Related U.S. Application Data

(62) Division of application No. 15/990,805, filed on May 28, 2018, now Pat. No. 10,563,277.

(30) Foreign Application Priority Data

Mar. 28, 2018 (KR) ..... 10-2018-0036093

(51) Int. Cl.

| | |
|---|---|
| ***C22C 38/32*** | (2006.01) |
| ***C21D 6/00*** | (2006.01) |
| ***C22C 38/54*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C21D 1/18*** | (2006.01) |
| ***C22C 38/06*** | (2006.01) |
| ***C22C 38/04*** | (2006.01) |
| ***C22C 38/02*** | (2006.01) |
| ***C22C 38/44*** | (2006.01) |

(52) U.S. Cl.

CPC ..... *C21D 6/008* (2013.01); *C21D 1/18* (2013.01); *C21D 6/004* (2013.01); *C21D 6/005* (2013.01); *C21D 6/007* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search

CPC ..... C21D 6/008; C21D 6/004; C21D 6/007; C21D 6/005; C22C 38/44; C22C 38/02; C22C 38/54; C22C 38/06; C22C 38/04; C22C 38/22; C22C 38/24; C22C 38/28; C22C 38/30; C22C 38/32; C22C 38/52; C22C 38/50; C22C 38/48; C22C 38/46

See application file for complete search history.

(56) References Cited

U.S. PATENT DOCUMENTS

| | | | | |
|---|---|---|---|---|
| 2011/0091348 | A1* | 4/2011 | Hatano ..... | C21D 8/0263 420/83 |
| 2015/0259771 | A1 | 9/2015 | Vartanov | |

FOREIGN PATENT DOCUMENTS

| | | | |
|---|---|---|---|
| JP | S58123860 | A | 7/1983 |
| JP | 10-2952245 | B2 | 4/1999 |
| JP | 2008-121032 | A | 5/2008 |
| JP | 2009242820 | A | 10/2009 |
| KR | 10-0834535 | B1 | 5/2007 |
| KR | 10-2014-0110120 | A | 9/2014 |

OTHER PUBLICATIONS

A Korean Office Action dated Jun. 10, 2019 in connection with Korean Patent Application No. 10-2018-0036093.

* cited by examiner

*Primary Examiner* — Jessee R Roe
(74) *Attorney, Agent, or Firm* — Invenstone Patent, LLC

(57) ABSTRACT

A hot-work mold steel includes 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti) and the remainder of iron (Fe) and inevitable impurities. The hot-work mold steel exhibits superior thermal conductivity, hardenability, durability, and nitriding characteristics, and increased resistance to heat check and melt-out. A die-casting mold made of the steel has improved thermal conductivity regardless of mold size and a prolonged life cycle and can improve the surface quality in manufactured parts.

6 Claims, 13 Drawing Sheets

HOT-WORK MOLD STEEL FOR DIE CASTING AND METHOD OF MANUFACTURING THE SAME

CROSS-REFERENCE TO RELATED APPLICATIONS

This application is a divisional of U.S. application Ser. No. 15/990,805, filed on May 28, 2018, which claims the benefit of Korean Patent Application No. 10-2018-0036093, filed Mar. 28, 2018, which is hereby incorporated by reference in its entirety into this application.

BACKGROUND OF THE INVENTION

1. Technical Field

The present disclosure relates to hot-work mold steel for die casting and a method of manufacturing the same, and more particularly to hot-work mold steel having a long life cycle with superior hardenability and nitriding characteristics, suitable for use in the production of vehicle parts, and a method of manufacturing the same.

2. Description of the Related Art

Alloy elements for hot-work mold steel include carbon, chromium, silicon, nickel, molybdenum, manganese, vanadium and cobalt, in addition to iron. Hot-work mold steel including such alloy elements may exhibit superior mechanical properties even at high temperatures, and is thus used for the production of extrusion dies, forging molds and die-casting molds, which require special mechanical strength at high processing temperatures.

Hot-work mold steel and steel products manufactured using the same, for example, molds such as die-casting dies, are applicable to a variety of technical processes. These applications require a uniform temperature on the entire surface of the mold so as to impart uniform quality to molded products, high thermal conductivity for sufficient dissipation of the generated heat during subsequent processing, and high thermal wear resistance.

Furthermore, resistance to heat check and melt-out of hot-work mold steel is directly associated with the life cycle of a hot-work mold, and thus, in order to maximize such properties, surface treatment including nitriding is performed. Since the depth to which introduced nitrogen penetrates the surface of the mold through nitriding and the extent of production of a nitrogen compound layer are directly associated with the chemical composition of a mold, resistance to heat check and melt-out due to nitriding is also directly affected by the chemical composition.

In addition to the above properties, hardenability of the hot-work mold steel is also regarded as important. As hardenability increases, a more homogeneous and robust steel structure may be obtained over a wider temperature range under the same heat-treatment conditions, and these same conditions may also be applied to relatively large molds. Hence, when hot-work mold steel has high hardenability, it is possible to manufacture more robust molds and molds of various sizes.

With the recent trends towards environmental friendliness and high fuel efficiency in the automotive industry, the use of lightweight non-iron metal is increasing and the demand for hot-work mold steel for die casting is also increasing. Since conventional techniques make it difficult to impart sufficient hardenability and nitriding characteristics to hot-work mold steel for die casting having a long life cycle, the development of hot-work mold steel that may overcome these problems is needed.

SUMMARY OF THE INVENTION

Accordingly, an objective of the present invention is to provide hot-work mold steel for die casting having a long life cycle with superior hardenability and nitriding characteristics by optimizing the composition of hot-work mold steel.

Another objective of the present invention is to provide preparation conditions for optimizing the composition of the hot-work mold steel.

The above and other objectives and advantages of the present invention will be more clearly understood from the following detailed description.

Therefore, an aspect of the present invention a hot-work mold steel including 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), and a remainder of iron (Fe) and impurities. The wt % values satisfy $$28.15-3.68Si-1.60Mn+51.22C-1.11Cr-2.18Ti-1.72V-413.6B-53.78C^2+93012B^2\geq 30.5$$

and $$10^{(3.389-0.6045Si-0.4541Mn-1.803C-0.3361Cr-0.5689Mo+0.581Ti+0.2902V-700.6B+115955B^2)}\leq 0.35$$

and are based on a total weight of the hot-work mold steel.

The hot-work mold steel may further include 0.001 to 0.007 wt % of tungsten (W), 0.001 to 0.025 wt % of niobium (Nb), and 0.005 to 0.022 wt % of cobalt (Co).

The hot-work mold steel may be a mold steel for die casting obtained through a quenching step and a tempering step. The quenching step may be performed in a temperature range of 1000 to 1040° C. and the tempering step may be performed in a temperature range of 520 to 640° C.

Another aspect of the present invention provides a method of manufacturing a hot-work mold steel. The method includes a forging step of heat-treating a hot-work mold steel ingot comprising 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), and a remainder of iron (Fe) and impurities; a quenching step of heating and then cooling a mold material obtained in the forging step; and a tempering step of heat-treating the mold material quenched in the quenching step in a temperature range of 520 to 640° C. The wt % values satisfy the above equations and are based on a total weight of the hot-work mold steel ingot.

The heat-treating in the forging step is preferably performed in a temperature range of 850 to 1300° C. and at a forging ratio of 4.5S or more.

The method preferably further includes a spheroidization heat-treatment step between the forging step and the quenching step, and the spheroidization heat-treatment step is preferably performed in a temperature range of 840 to 900° C.

In the quenching step, the heating may be performed in a temperature range of 1000 to 1040° C., and the cooling may be performed at a cooling rate of 0.2 to 3.0° C./s. Through such cooling, the temperature is preferably lowered to the range of 80 to 100° C.

The tempering step may include a first tempering stage of heat-treating the quenched mold material in a temperature range of 540 to 630° C. for a period of 2 to 6 hr and a second tempering stage of heat-treating the mold material in a temperature range of 540 to 620° C. for a period of 2 to 6 hr, and may further include a third tempering stage of heat-treating the hot-work mold steel obtained through the second tempering stage in a temperature range of 540 to 610° C. for a period of 2 to 6 hr.

The method may further include a nitriding heat-treatment step after the tempering step, the nitriding heat-treatment step being performed through any one process selected from among a nitriding process, a gas nitriding process, a nitrocarburizing process, an ion nitriding process, and a nitrosulfurizing process.

The hot-work mold steel ingot may further include 0.001 to 0.007 wt % of tungsten (W), 0.001 to 0.025 wt % of niobium (Nb), and 0.005 to 0.022 wt % of cobalt (Co).

According to the present invention, hot-work mold steel can manifest superior hardenability, durability and nitriding characteristics to thus exhibit high resistance to heat check and melt-out, whereby molds of various sizes ranging from small sizes to large sizes can be manufactured and the life cycle of molds can be remarkably increased.

Also, according to the present invention, the hot-work mold steel has high thermal conductivity at high temperatures, and thus the surface quality of parts manufactured using the mold can be improved.

The effects of the present invention are not limited to the foregoing and should be understood to incorporate all effects that can be reasonably inferred from the following description.

DETAILED DESCRIPTION OF THE INVENTION

Figure 1A:
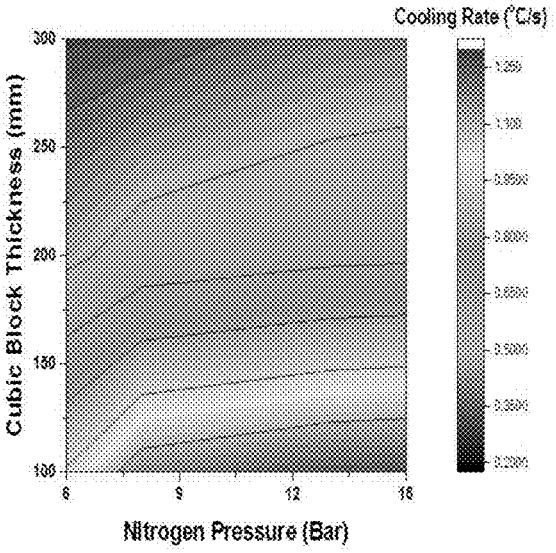
FIGS. 1A and 1B are graphs showing the thickness of the hot-work mold steel versus the cooling rate depending on the nitrogen pressure upon cooling in a quenching step, FIG. 1A illustrating the cooling rate of the center and FIG. 1B illustrating the cooling rate of the surface.

Hereinafter, a detailed description will be given of preferred embodiments of the present invention. However, the embodiments of the present invention may be modified in a variety of different forms, and are not to be construed as limiting the scope of the present invention. Furthermore, the embodiments of the present invention are provided to fully describe the present invention to those having ordinary knowledge in the art to which the present invention pertains.

Throughout the present description, it is to be understood that when any part is referred to as "comprising" or "including" any element, it does not exclude but may further include other elements unless otherwise stated.

Also, as used herein, all percentages defined by mass are as those defined by weight. According to an embodiment of the present invention, hot-work mold steel includes carbon (C), silicon (Si), manganese (Mn), chromium (Cr), molybdenum (Mo), vanadium (V), boron (B), aluminum (Al) and titanium (Ti), with the remainder of iron (Fe), trace elements and inevitable impurities.

Specifically, the hot-work mold steel includes, based on the total weight thereof, 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), and the remainder of iron (Fe) and inevitable impurities. When the amounts of individual elements for the hot-work mold steel are substituted into Equation 1 below, the resulting value is 30.5 or more, and when these values are substituted into Equation 2 below, the resulting value satisfies 0.35 or less.

$$28.15-3.68Si-1.60Mn+51.22C-1.11Cr-2.18Ti-1.72V-413.6B-53.78C^2+93012B^2 \geq 30.5 \quad \text{Equation 1}$$

$$10^{(3.389-0.6045Si-0.4541Mn-1.803C-0.3361Cr-0.5689Mo+0.581Ti+0.2902V-700.6B+115955B^2)} \leq 0.35 \quad \text{Equation 2}$$

The hot-work mold steel may further include 0.001 to 0.007 wt % of tungsten (W), 0.001 to 0.025 wt % of niobium (Nb), and 0.005 to 0.022 wt % of cobalt (Co). Furthermore, the inevitable impurities may include phosphorus (P), sulfur (S), nitrogen (N) and oxygen (O), and may also include other materials.

The reason why the components and amounts of the hot-work mold steel are limited as above is described below.

Carbon (C)

Carbon, which is essential for controlling the strength of steel, is an element that forms alloy carbides in the present alloy system to thus affect grain refinement, has an influence on durability such as high-temperature yield strength through secondary hardening, and effectively improves the hardenability of the alloy during heat-treatment in the quenching step.

If the amount of carbon is less than 0.37 wt %, hardness and strength may decrease, and hardenability is lowered, making it impossible to obtain uniform cross-sectional hardness. On the other hand, if the amount thereof exceeds 0.46 wt %, crystallized carbides may be formed, which thus not only deteriorates the fatigue strength and impact resistance, but also significantly reduces the martensite transformation temperature, thereby increasing the amount of residual austenite after the heat-treatment in the quenching step, ultimately causing the dimensional change and low toughness of steel subjected to the fmal heat-treatment.

Hence, in order to impart superior hardness and strength to the hot-work mold steel while preventing other properties from deteriorating, the hot-work mold steel of the present invention preferably contains 0.37 to 0.46 wt % of carbon.

Silicon (Si)

Silicon is an element that inhibits the decomposition of residual austenite produced through the heat-treatment in the quenching step in the present alloy system into acicular cementite upon heat-treatment in the tempering step. Here, since acicular cementite may drastically reduce the resistance to heat check that occurs during the die-casting process, resistance to heat check may be improved by increasing the toughness of the steel by including an appropriate amount of silicon in the mold steel.

Also, silicon contributes to increasing hardenability but may deteriorate thermal conductivity, and thus is preferably used within a range that does not significantly affect thermal conductivity. If the amount of silicon is less than 0.25 wt % based on the total weight of the hot-work mold steel, an improvement in resistance to heat check becomes insignificant. On the other hand, if the amount of silicon exceeds 0.5 wt %, thermal conductivity may decrease. Hence, the hot-work mold steel of the present invention preferably contains 0.25 to 0.5 wt % of silicon.

Manganese (Mn)

Manganese is an element that increases hardenability and causes solid-solution strengthening. If the amount of manganese is less than 0.36 wt % based on the total weight of the hot-work mold steel, it is difficult to improve hardenability and obtain solid-solution strengthening effects. On the other hand, if the amount of manganese exceeds 0.56 wt %, thermal conductivity is considerably decreased. Hence, in order to ensure the effects of manganese and prevent thermal conductivity from deteriorating, manganese is preferably added in an amount of 0.36 to 0.56 wt % based on the total weight of the hot-work mold steel.

Chromium (Cr)

Chromium is an element that increases hardenability and forms composite carbides to thus improve hardness, strength, and softening resistance and wear resistance in the tempering step, and enhances surface hardness by forming a nitrogen compound in the nitriding step. The amount of chromium is preferably 2.0 to 5.0 wt % based on the total weight of the hot-work mold steel. If the amount thereof is less than the above lower limit, it is difficult to expect an increase in hardenability. On the other hand, if the amount thereof exceeds the above upper limit, thermal conductivity may decrease. Hence, chromium is preferably contained within the above weight range.

Molybdenum (Mo)

Molybdenum is an element that forms a carbide, such as molybdenum carbide, thus increasing high-temperature hardness and strength, and causes secondary hardening at high temperatures upon tempering, thereby increasing high-temperature strength. Moreover, it is coupled with phosphorus (P) present at the grain boundary to thus prevent tempering brittleness due to phosphorus upon heat-treatment during the tempering and does not affect thermal conductivity. Hence, molybdenum is preferably contained in an amount of 1.2 wt % or more based on the total weight of the hot-work mold steel. More preferably, molybdenum is contained in an amount of 1.4 to 2.6 wt %. If the amount of molybdenum is less than 1.4 wt %, the ability to inhibit tempering brittleness due to phosphorus is reduced, and secondary hardening does not sufficiently occur, and thus hardness and strength may decrease at high temperatures. On the other hand, if the amount of molybdenum exceeds 2.6 wt %, the effects of molybdenum on improving strength and inhibiting tempering brittleness may decrease.

Tungsten (W)

Tungsten is an element that may be optionally added in order to increase the strength of hot-work mold steel. Precipitation hardening of carbide is induced, thereby increasing the strength of hot-work mold steel and exhibiting secondary hardening effects, like molybdenum. Tungsten may be contained in an amount of 0.001 to 0.007 wt % based on the total weight of the hot-work mold steel. If the amount of tungsten is less than the above lower limit, the effect of improving the strength of the mold steel is insignificant. On the other hand, if the amount of tungsten exceeds the above upper limit, the thermal conductivity of the mold steel may decrease. Hence, tungsten is preferably contained within the above weight range.

Titanium (Ti)

Titanium is an element that has low solubility in austenite to thus produce a strong precipitation phase and imparts structural refinement effects in the present alloy system. However, titanium has high ability to bind to carbon, and thus the amount of carbon in the austenite matrix may be decreased, undesirably deteriorating the hardenability of the hot-work mold steel. Since the extent of decreasing hardenability is great compared to vanadium, titanium is preferably contained such that structural refinement effects are sufficiently exhibited and hardenability is not significantly deteriorated. Specifically, when titanium is contained in an amount of 0.001 to 0.09 wt % based on the total weight of the hot-work mold steel, the above effects may be obtained, and side effects may be minimized.

Vanadium (V)

Vanadium is an element that increases tensile strength through substitutional solid-solution with iron, and forms insoluble carbides to thus increase high-temperature hardness and tempering brittleness resistance. In particular, vanadium has an effect of inhibiting austenite grain growth by finely producing a stable precipitation phase at a high temperature. Although vanadium causes grain refinement by forming strong alloy carbides together with titanium and niobium, the likelihood of crystallization thereof is low due to the low ability to bind to carbon compared to titanium and niobium, and the decrease in the amount of carbon in the austenite matrix is smaller, so that vanadium has an insignificant effect on thermal conductivity and hardenability deterioration.

If the amount of vanadium is less than 0.4 wt % based on the total weight of the hot-work mold steel, it is difficult to sufficiently obtain grain refinement effects. On the other hand, if the amount thereof exceeds 0.8 wt %, crystallized carbides may be formed. Hence, vanadium is preferably contained in an amount of 0.4 to 0.8 wt % based on the total weight of the hot-work mold steel.

Niobium (Nb)

Niobium is an element that has low solubility in austenite to thus produce a strong precipitation phase and imparts structural refinement effects, like titanium. Also, niobium may strongly bind to carbon, whereby the amount of carbon in the austenite matrix is decreased to thus reduce the hardenability of the hot-work mold steel, and the extent of reduction thereof is larger than vanadium, which is an alloy element that serves for grain refinement.

If the amount of niobium is less than 0.001 wt % based on the total weight of the hot-work mold steel, it is difficult to obtain the structural refinement effects of the niobium. On the other hand, if the amount thereof exceeds 0.025 wt %, the hardenability of the hot-work mold steel may decrease. Hence, niobium is preferably contained in an amount of 0.001 to 0.025 wt % based on the total weight of the hot-work mold steel.

Boron (B)

Boron is an element that may greatly improve hardenability through grain boundary segregation even when added in a very small amount. If the amount of boron is less than 0.0007 wt % based on the total weight of the hot-work mold steel, it is difficult to sufficiently increase hardenability. On the other hand, if the amount thereof exceeds 0.004 wt %, the increase in hardenability is insignificant relative to the additionally added amount, thus negating economic benefits. Hence, boron is preferably contained in an amount of 0.0007 to 0.004 wt % based on the total weight of the hot-work mold steel.

Cobalt (Co)

Cobalt is an element that is dissolved only in a matrix to thus increase carbon solubility, and is capable of subjecting a large amount of carbide to solid solution in a matrix and exhibiting matrix-strengthening effects due to solid-solution strengthening. The above effects may be obtained when cobalt is added in an amount of 0.005 to 0.022 wt % based on the total weight of the hot-work mold steel. If the cobalt is added in an amount falling outside of the above weight range, the above effects cannot be obtained, or it may be difficult to expect an additional effect depending on the excess amount. Hence, cobalt is preferably contained within the above weight range.

Phosphorus (P)

Phosphorus is an element that partially contributes to increasing the strength of hot-work mold steel. If the amount of phosphorus exceeds 0.007 wt %, weldability may deteriorate. Hence, phosphorus is preferably contained in an amount of 0.007 wt % or less, and more preferably 0.005 to 0.006 wt %.

Sulfur (S)

Sulfur is an element that is coupled with manganese to thus cause toughness deterioration and high-temperature cracking. Hence, sulfur is preferably contained in an amount of 0.003 wt % or less.

Nitrogen (N)

Nitrogen is an impurity contained during steelmaking. When nitrogen boride is formed to obtain the grain boundary segregation effect of boron, the properties of the hot-work mold steel may suffer, but solid-solution strengthening effects may be exhibited. In order to obtain the above effects while preventing the properties from deteriorating, nitrogen is preferably contained in an amount of 0.005 to 0.06 wt %.

Aluminum (Al)

Aluminum is an element that is added to offset the side effects due to the nitrogen boride because of its high ability to bind to nitrogen compared to boron. When aluminum is added in an amount of 0.002 to 0.022 wt %, aluminum may be used to remove only a trace amount of nitrogen which is subjected to solid solution. If the amount thereof falls outside of the above range, the properties of the mold steel may deteriorate. Hence, aluminum is preferably added within the above weight range.

The hot-work mold steel of the present invention is configured such that the remainder other than the above components is substantially composed of iron (Fe). Here, the expression "the remainder is substantially composed of iron (Fe)" means that the inclusion of inevitable impurities and other trace elements may also be incorporated in the scope of the present invention, so long as this does not interfere with the effects of the present invention.

As described hereinbefore, when the amounts of carbon, silicon, manganese, chromium, vanadium, boron and titanium, which constitute the hot-work mold steel of the present invention, are substituted into Equation 1 below, the resulting value satisfies 30.5 W/mK or more. When a die-casting process is performed using a mold produced using the hot-work mold steel having high thermal conductivity, the temperature difference between the inside and outside of the mold is reduced to thus improve the resistance to heat check of the mold, thereby prolonging the life cycle of the mold and improving the surface quality of a product made using such a mold.

$$28.15-3.6851-1.60Mn+51.22C-1.11Cr-2.18Ti-1.72V-413.6B-53.78C^2+93012B^2 \geq 30.5 \quad \text{Equation 1}$$

Equation 1 is an equation made using the Box-Behnken design in the experimental design method by producing 161 kinds of alloys within the above alloy element content ranges composed of 8 alloy elements, determining the thermal conductivity of the produced alloys at 400° C. using computer simulation software (J-Mat Pro) and then deriving statistically significant coefficients in the complete quadratic model. In particular, since thermal conductivity is greatly affected by carbon and boron, the amounts of carbon and boron are limited as above in the present invention, thereby improving the thermal conductivity of the hot-work mold steel according to the present invention.

Here, Equation 1 denotes the calculated thermal conductivity of the alloy at 400° C., which is slightly greater than the thermal conductivity obtained through actual experiments, and 400° C. is the representative temperature obtained by the melt during the die casting of the hot-work mold steel, and thus a relation based on thermal conductivity at 400° C. is employed.

The wt % values of the elements for the hot-work mold steel according to the present invention satisfy Equation 1. The reason why the minimum in Equation 1 is set to 30.5 W/mK is that when the value obtained by substituting the wt % values of the elements for the hot-work mold steel according to the present invention into Equation 1 is 30.5 W/mK or more, the heat crack length is remarkably decreased, which can be seen in Test Example 8, as will be described later.

The mold produced using the hot-work mold steel having high thermal conductivity is alleviated in temperature non-uniformity at different portions of the mold, thus reducing shrinkage or distortion of molded products, thereby manufacturing molded products having uniform quality and also improving the overall quality of the molded products. Furthermore, the frequency and extent of heat-check cracking due to the temperature difference depending on the portion of the mold may decrease, thereby considerably prolonging the life cycle of the mold.

Also, the wt % values of carbon, silicon, manganese, chromium, vanadium, boron, molybdenum and titanium for the hot-work mold steel according to the present invention satisfy Equation 2, and the hot-work mold steel having a low critical cooling rate may exhibit superior hardenability.

$$10^{(3.389-0.6045Si-0.4541Mn-1.803C-0.3361Cr-0.5689Mo+0.581Ti+0.2902V-700.6B+115955B^2)}\leq 0.35 \quad \text{Equation 2}$$

Equation 2 is an equation made by deriving the continuous cooling diagram of 161 kinds of alloys, which are the same as in Equation 1, using computer simulation software (J-Mat Pro), determining the lowest cooling rate (critical cooling rate) that does not cause pearlite transformation or bainite transformation during the cooling, and then deriving statistically significant coefficients in the quadratic model.

The critical cooling rate has an influence on hardenability of steel, and when the steel is cooled faster than the critical cooling rate in the quenching step, complete martensite up to the inside of the steel may be obtained. As the critical cooling rate decreases, the size of a product able to make a complete martensite structure at a given cooling rate is increased, and the thickness of the surface having the complete martensite structure is increased. Hence, a low critical cooling rate is favorable in terms of manufacturing products.

As confirmed using Equation 2, since the critical cooling rate is greatly affected by carbon and boron, the amounts of carbon and boron are limited as above in the present invention, whereby the critical cooling rate is decreased, ultimately obtaining steel having high hardenability.

Figure 1B:
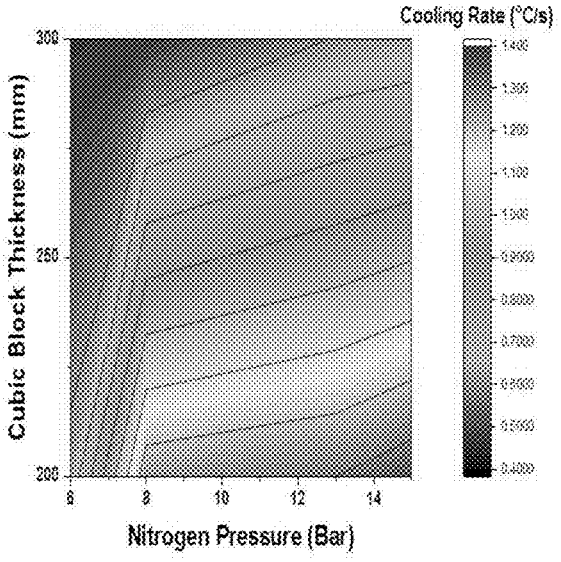

As shown in FIGS. 1A and 1B, both the center and the surface exhibit a low cooling rate with an increase in the thickness of the hot-work mold steel. When the cooling rate is lower than the critical cooling rate, hardenability may deteriorate, making it impossible to impart sufficient mechanical properties to the steel. Hence, it is necessary to ensure a low critical cooling rate.

Typically, the thermal conductivity and hardenability of steel are in inverse proportion to each other, and thus steel in which both thermal conductivity and hardenability are superior is difficult to obtain through conventional methods. In the present invention, however, the amounts of carbon and boron for the steel are limited to 0.37 to 0.46 wt % and 0.0007 to 0.004 wt %, respectively, thereby realizing hot-work mold steel in which both high-temperature thermal conductivity and hardenability are superior.

In addition, a method of manufacturing hot-work mold steel according to another embodiment of the present invention includes a forging step of heat-treating a hot-work mold steel ingot comprising, based on the total weight thereof, 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), and the remainder of Fe and inevitable impurities; a quenching step of heating and then cooling the mold material obtained in the forging step; and a tempering step of heat-treating the mold material quenched in the quenching step.

The value obtained by substituting the amounts of the elements for the hot-work mold steel into Equation 1 below is 30.5 or more, and the value obtained by substituting the amounts of the elements for the hot-work mold steel into Equation 2 below is 0.35 or less.

$$28.15-3.68Si-1.60Mn+51.22C-1.11Cr-2.18Ti-1.72V-413.6B-53.78C^2+93012B^2\geq 30.5 \quad \text{Equation 1}$$

$$10^{(3.389-0.6045Si-0.4541Mn-1.803C-0.3361Cr-0.5689Mo+0.581Ti+0.2902V-700.6B+115955B^2)}\leq 0.35 \quad \text{Equation 2}$$

Also, the hot-work mold steel ingot may further comprise 0.001 to 0.007 wt % of tungsten, 0.001 to 0.025 wt % of niobium, and 0.005 to 0.022 wt % of cobalt, and examples of the inevitable impurities may include, but are not limited to, phosphorus, sulfur, nitrogen, and the like. Furthermore, the effects obtained by limiting the kinds and amounts of the elements for the hot-work mold steel ingot and the upper and lower limits of the amounts thereof remain the same as in the hot-work mold steel described above, and thus a description thereof is omitted.

The method of manufacturing the hot-work mold steel includes preparing the hot-work mold steel ingot by melting metals using any one selected from among artificial heat sources, for example, an electric furnace, a vacuum induction furnace, and an atmospheric induction furnace and then removing gas such as oxygen, hydrogen, nitrogen, etc. generated during steelmaking.

Next, a forging step of heat-treating the hot-work mold steel ingot in a temperature range of 850 to 1300° C. is performed. Through the forging step, the cast structure of the hot-work mold steel ingot is broken and pores in the hot-work mold steel ingot generated upon solidification are compressed and removed, thereby improving the quality of the interior of the hot-work mold steel ingot. As such, the mold material may be formed in a predetermined shape.

If the temperature of the above step is lower than 850° C., it is difficult to change the shape during the forging process, thus causing cracking. On the other hand, if the temperature thereof is higher than 1300° C., cracking may occur because of high-temperature brittleness due to overheating. Hence, heat-treatment is preferably carried out in the above temperature range.

Also, the forging ratio in the forging process is preferably 4.5S or more. When the hot-work mold steel ingot is forged at such a forging ratio, the efficiency of compressing and removing the pores in the hot-work mold steel ingot is increased, whereby the structure of the hot-work mold steel may become very fine. If the forging ratio is less than 4.5S, the structure of the mold steel may become coarse, thus weakening toughness to thereby deteriorate the quality of a product obtained upon die casting. Hence, the forging step is preferably carried out at a forging ratio of 4.5S or more.

Next, a spheroidization heat-treatment step may be performed. In the spheroidization heat-treatment step, the mesh-type carbide formed in the microstructure of the mold material through the forging process is decomposed and spheroidized, whereby the amount of carbon is made uniform, thus increasing the efficiency of the subsequent quenching step to ultimately increase the strength and hardness of the hot-work mold steel ingot. Here, if the heat-treatment temperature is lower than 840° C., the decomposition of the mesh-type carbide does not sufficiently progress, and thus the extent of increase in the quenching efficiency is low. On the other hand, if the heat-treatment temperature is higher than 900° C., alloy carbides produced through the spheroidization heat-treatment step become coarse, making it difficult to obtain desired properties after the quenching step. Hence, the spheroidization heat-treatment step is preferably carried out in a temperature range of 840 to 900° C.

Next, a quenching step is performed through heat-treatment and then cooling. If the heat-treatment temperature in the quenching step is lower than 1000° C., the solid-solution effects of the added alloy elements are low, and thus hardenability may decrease. On the other hand, if the heat-treatment temperature is higher than 1040° C., the temperature at which the martensite transformation is initiated is lowered due to the coarsening of the particles, and thus the amount of residual austenite may increase. Therefore, the mechanical properties may deteriorate and the material may become non-uniform, resulting in dimensional changes in the mold. Hence, the heat-treatment is preferably carried out in a temperature range of 1000 to 1040° C.

After the heat-treatment process in the quenching step, a cooling process may be performed. As such, cooling is conducted at a rate of 0.35° C./s or more, and preferably 0.5 to 3.0° C./s, until the temperature reaches the range of 80 to 100° C., thereby further increasing the strength of the mold steel. Here, since the cooling is performed using a high-pressure nitrogen pressurized cooler, the above cooling rate may be achieved.

After the quenching step, a tempering step is performed. Here, the heat-treatment temperature is preferably set to the range of 520 to 640° C. If the tempering temperature is lower than 520° C., secondary hardening does not sufficiently occur, making it difficult to obtain desired properties, or tempering brittleness occurs due to the carbide produced upon secondary hardening. On the other hand, if the tempering temperature is higher than 640° C., the strength of the mold steel may drastically decrease. Hence, the tempering step is preferably carried out in the above temperature range.

The tempering is performed in order to improve the toughness of the hot-work mold steel, and is preferably conducted in a multi-stage manner in the present invention. Specifically, the tempering step may include first tempering in a temperature range of 540 to 630° C. for 2 to 6 hr and then second tempering in a temperature range of 540 to 620° C. for 2 to 6 hr.

Subsequently, the hot-work mold steel obtained through second tempering may be further subjected to third tempering through heat-treatment in a temperature range of 540 to 610° C. for 2 to 6 hr.

Upon the multi-stage tempering, austenite that remains in the mold steel structure is decomposed into bainite or is transformed into martensite through first tempering, thus decreasing toughness, and the produced martensite is decomposed through second tempering, thus increasing toughness, and the hardness of the mold material may be precisely controlled through third tempering.

Thereafter, in order to increase the surface hardness of the hot-work mold steel manufactured by the above method, a surface nitriding heat-treatment step may be further performed. Examples of the nitriding heat-treatment may include, but are not limited to, a nitriding process in which the steel material is heated at about 500° C. or higher for about 18 to 19 hr in the presence of ammonia gas and then naturally cooled, a gas nitriding process using a nitrogen element resulting from pyrolysis of ammonia and CO gas supplied from a carburizing gas, a nitrocarburizing process based on the decomposition of alkali metal cyanate (MCNO) at 500° C. or higher, an ion nitriding process in which $N^+$ ions generated by ionizing nitrogen gas using discharge energy undergoes nitriding on the negatively charged surface of the steel material, and a nitrosulfurizing process using plasma.

A better understanding of the present invention will be given of the following examples, which are merely set forth to illustrate but are not to be construed as limiting the scope of the present invention.

PREPARATION EXAMPLE

Each of steel ingots having the compositions shown in Table 1 below was forged at a forging ratio of 5 S at about 1185° C. to give a mold material, which was then subjected to spheroidization heat-treatment at 840° C. for about 10 hr. Subsequently, the mold material was quenched through heat-treatment at 1030° C. for 2 hr. and cooling to about 90° C. at a cooling rate of about 0.5° C./s, followed by first tempering at 595° C. for 3 hr, second tempering at 590° C. for 3 hr and then third tempering at 580° C. for 3 hr, thereby manufacturing hot-work mold steels of Examples 1 to 3 and Comparative Examples 1 to 8.

TABLE 1

| Example | C | Si | Mn | Cr | Mo | V | B | Al | Ti | W | Nb | Co | Ni |
|---|---|---|---|---|---|---|---|---|---|---|---|---|---|
| Ex. 1 | 0.38 | 0.49 | 0.45 | 4.65 | 1.44 | 0.626 | 0.0027 | 0.003 | 0.001 | 0.003 | 0.003 | 0.011 | 0.11 |
| Ex. 2 | 0.42 | 0.48 | 0.44 | 4.95 | 1.41 | 0.580 | 0.0010 | 0.002 | 0.001 | 0.006 | 0.001 | 0.005 | 0.08 |
| Ex. 3 | 0.37 | 0.31 | 0.48 | 2.92 | 1.86 | 0.590 | 0.0019 | 0.019 | 0.004 | 0.000 | 0.023 | 0.019 | 0.09 |
| Comp. Ex. 1 | 0.45 | 0.30 | 0.46 | 4.90 | 1.27 | 0.529 | 0.0003 | 0.000 | 0.000 | 0.000 | 0.000 | 0.000 | 0.12 |
| Comp. Ex. 2 | 0.39 | 0.32 | 0.45 | 2.93 | 1.46 | 0.590 | 0.0008 | 0.037 | 0.000 | 0.000 | 0.000 | 0.000 | 0.05 |
| Comp. Ex. 3 | 0.40 | 0.51 | 1.17 | 1.00 | 2.5 | 1.210 | 0.0016 | 0.024 | 0.000 | 0.000 | 0.000 | 0.000 | 0.10 |
| Comp. Ex. 4 | 0.41 | 0.26 | 0.40 | 2.04 | 2.58 | 0.410 | 0.0007 | 0.055 | 0.090 | 0.000 | 0.000 | 0.000 | 1.02 |
| Comp. Ex. 5 | 0.38 | 0.91 | 0.42 | 5.16 | 1.22 | 0.850 | 0.0001 | 0.011 | 0.001 | 0.003 | 0.003 | 0.015 | 0.05 |
| Comp. Ex. 6 | 0.38 | 0.31 | 0.45 | 4.87 | 1.17 | 0.590 | 0.0009 | 0.048 | 0.020 | 0.000 | 0.025 | 0.000 | 0.10 |
| Comp. Ex. 7 | 0.37 | 1.00 | 0.25 | 5.00 | 1.25 | 1.000 | 0.0000 | 0.000 | 0.000 | 0.000 | 0.000 | 0.000 | 0.00 |
| Comp. Ex. 8 | 0.41 | 0.44 | 0.42 | 3.96 | 1.43 | 0.700 | 0.0010 | 0.005 | 0.003 | 0.000 | 0.000 | 0.000 | 0.00 |

(unit: wt %)

Test Example 1

Figure 2:
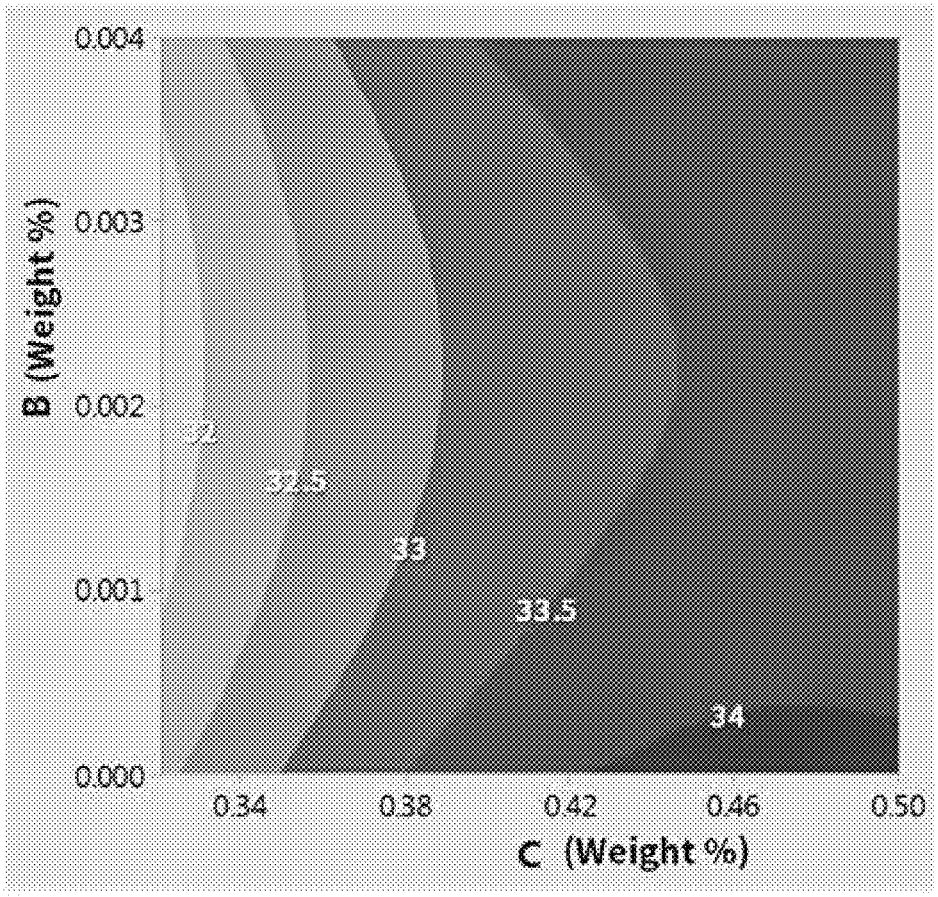
FIG. 2 is a graph showing the thermal conductivity represented by Equation 1 depending on the amounts of carbon and boron.
Figure 3:
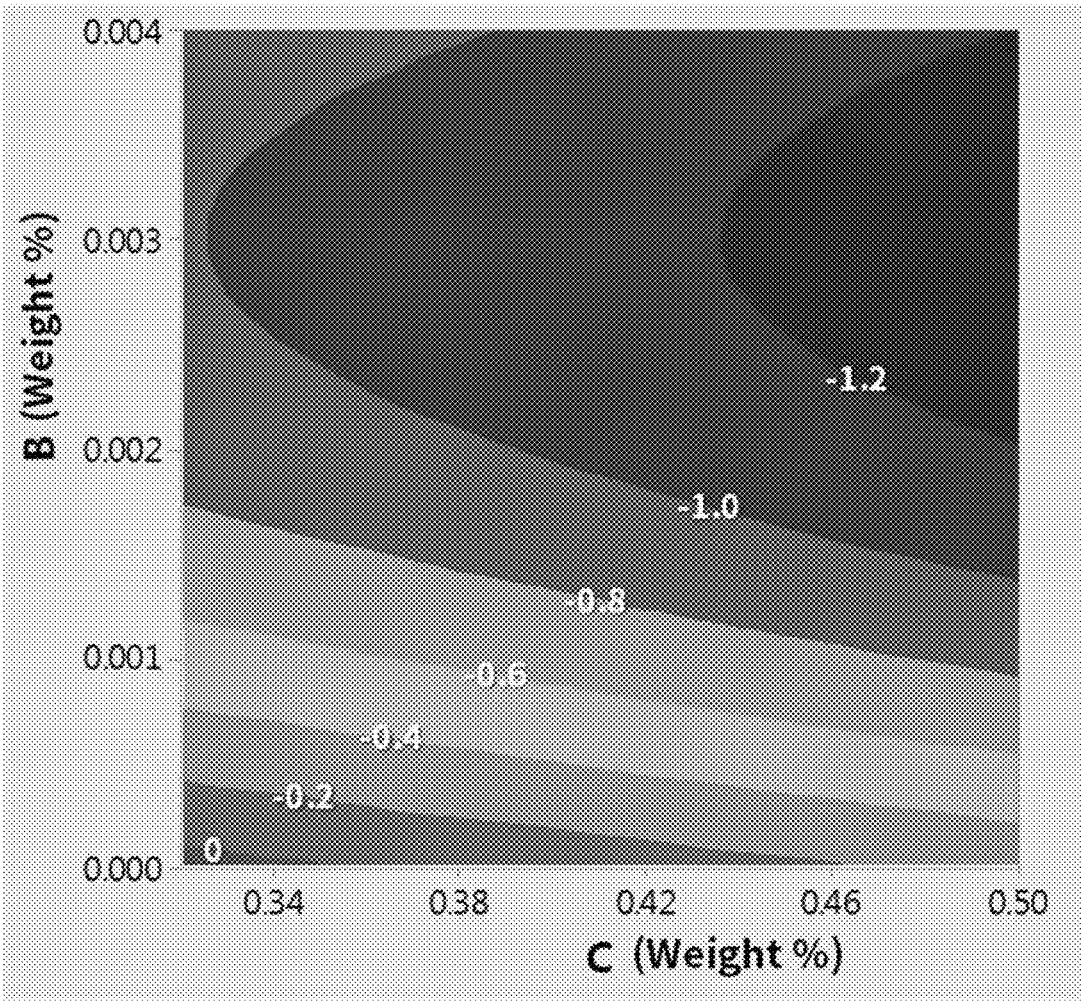
FIG. 3 is a graph showing the critical cooling rate represented by Equation 2 depending on the amounts of carbon and boron.

Simulation of Thermal Conductivity and Critical Cooling Rate Depending on Amounts of Carbon and Boron The thermal conductivity, represented by Equation 1, at 400° C. depending on changes in the amounts of carbon and boron was simulated using computer simulation and statistical tools. The results are shown in FIG. 2. The log value of the critical cooling rate, represented by Equation 2, was simulated. The results are shown in FIG. 3. Here, the amounts of silicon, manganese, chromium, molybdenum, titanium and vanadium were fixed to 0.45, 0.46, 4.8, 1.45, 0.001 and 0.6 wt %, respectively.

As shown in FIG. 2, when the amount of carbon was 0.37 wt % or more, thermal conductivity, calculated using Equation 1, was 30.5 W/mK or more, and thus resistance to heat check of the mold steel was confirmed to be superior. As shown in FIG. 3, when the amount of boron was 0.0007 wt % or more, the critical cooling rate was 0.35° C./s or less, that is, the log value of the critical cooling rate was −0.45 or less, from which the hardenability of the mold steel was confirmed to be superior.

Thus, when the mold steel of the present invention contains 0.37 wt % or more of carbon and simultaneously 0.0007 wt % or more of boron, both thermal conductivity and hardenability can be found to be superior, unlike conventional mold steel.

Test Example 2

Measurement of Thermal Conductivity and Critical Cooling Rate

The values of thermal conductivity and critical cooling rate of the hot-work mold steels of Examples 1 to 3 and Comparative Examples 1 to 8, calculated in the same manner as in Test Example 1, are shown in Table 2 below. Also, the results of measurement of thermal conductivity and critical cooling rate of some hot-work mold steels are shown together in Table 2.

The thermal conductivity of Example 1 and Comparative Examples 1 to 5 and 7 was measured, the thermal conductivity being calculated by measuring the density, specific heat and thermal diffusivity. Here, the density was measured through an underwater substitution process, and the specific heat and thermal diffusivity were measured using a laser flash process.

Figure 4:
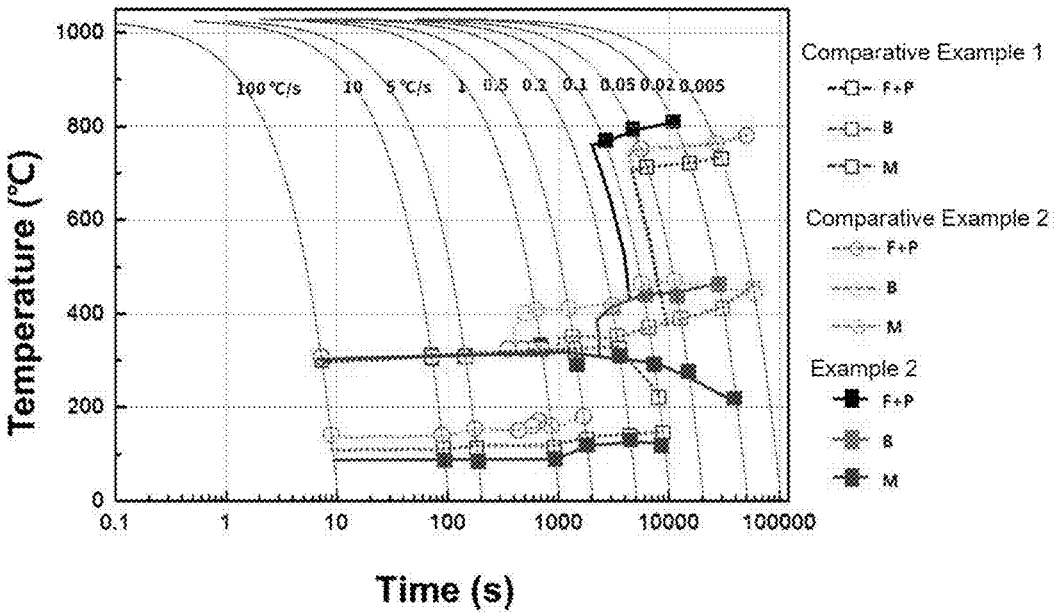
FIG. 4 is a graph showing the continuous cooling transformation diagram of Test Example 2.

Also, the critical cooling rate of Example 2 and Comparative Examples 1 and 2 were measured, and the continuous cooling transformation diagram of FIG. 4 was derived using a dilatometer, from which the lowest cooling rate at which transformation did not occur upon cooling was then determined to be the critical cooling rate.

TABLE 2

| Example | Measured thermal conductivity (W/mK) | Value of Equation 1 (W/mK) | Critical cooling rate derived from continuous cooling transformation diagram (° C./s) | Value of Equation 2 (° C./s) |
|---|---|---|---|---|
| Ex. 1 | 31.7 | 30.6 | — | 0.09 |
| Ex. 2 | — | 30.9 | 0.20 | 0.18 |
| Ex. 3 | — | 33.1 | — | 0.35 |
| Comp. Ex. 1 | 31.8 | 32.0 | 0.50 | 0.59 |
| Comp. Ex. 2 | 33.8 | 33.5 | 1.25 | 1.44 |
| Comp. Ex. 3 | 33.3 | 32.7 | — | 0.40 |
| Comp. Ex. 4 | 34.4 | 35.1 | — | 0.79 |
| Comp. Ex. 5 | 28.2 | 28.6 | — | 0.52 |
| Comp. Ex. 6 | — | 31.2 | — | 0.45 |
| Comp. Ex. 7 | 28.2 | 28.4 | — | 0.80 |
| Comp. Ex. 8 | — | 31.9 | — | 0.47 |

Based on the test results, the simulation value of thermal conductivity using Equation 1 and the actual measurement value thereof were slightly different, but the tendencies thereof appeared to be exactly the same, and Equation 1 was thus confirmed to be utilized as an indicator of thermal conductivity. Similarly, the critical cooling rate using Equation 2 and the critical cooling rate derived from the continuous cooling transformation diagram were slightly different in absolute values thereof, but the tendencies thereof appeared to be the same, and Equation 2 was thus confirmed to be useful as an indicator of the critical cooling rate.

Accordingly, the value calculated using Equation 1 and the value calculated using Equation 2 were used as the thermal conductivity and the critical cooling rate, respectively.

All of the thermal conductivity values using Equation 1 were 30.5 W/mK or more, except for the mold steels of Comparative Examples 5 and 7, and the critical cooling rate using Equation 2 was 0.35° C./s or less only in Examples 1 to 3, whereby all the mold steels of Examples satisfied the conditions of Equations 1 and 2 and thus exhibited high thermal conductivity and superior hardenability.

Test Example 3

Evaluation of Properties

The hot-work mold steel of each of Example 2 and Comparative Examples 1, 2 and 4 was manufactured into a test sample having a size of 300×300×300 mm, and the surface thereof in a forging length direction was measured for tensile strength and impact toughness. The results are shown in Table 3 below. Also, the results of measurement of hardness before the properties were measured are shown together in Table 3 below. Tensile strength was tested at room temperature in accordance with ASTM E8, and impact toughness was tested at room temperature through a Charpy impact test (2 mm U-notch) in accordance with ASTM E23.

TABLE 3

| Example | Value of Equation 2 (° C./s) | Tensile strength (Mpa) (Hardness (HRc)) | Impact toughness (J) (Hardness (HRc)) |
|---|---|---|---|
| Ex. 2 | 0.18 | 1566 (45.7) | 29.7 (49.6) |
| Comp. Ex. 1 | 0.59 | 1548 (45.5) | 25.0 (49.7) |
| Comp. Ex. 2 | 1.44 | 1487 (45.8) | 8.8 (49.1) |
| Comp. Ex. 4 | 0.79 | 1492 (45.6) | 5.2 (49.2) |

As is apparent from the results of Table 3, the tensile strength of Example 2 at hardness of about 46 HRc was the greatest, and impact toughness of Example 2 at the same hardness was vastly superior.

This is deemed to be because Example 2 satisfies both the composition limited in the present invention and Equation 2. In particular, a low critical cooling rate is ensured by satisfying Equation 2, thus improving hardenability, ultimately increasing tensile strength and impact toughness.

Therefore, in the alloy system of the present invention, it is preferred that both the composition limited in the present invention and Equation 2 be satisfied in order to increase the tensile strength and impact hardness of the hot-work mold steel.

Test Example 4

Figure 5:
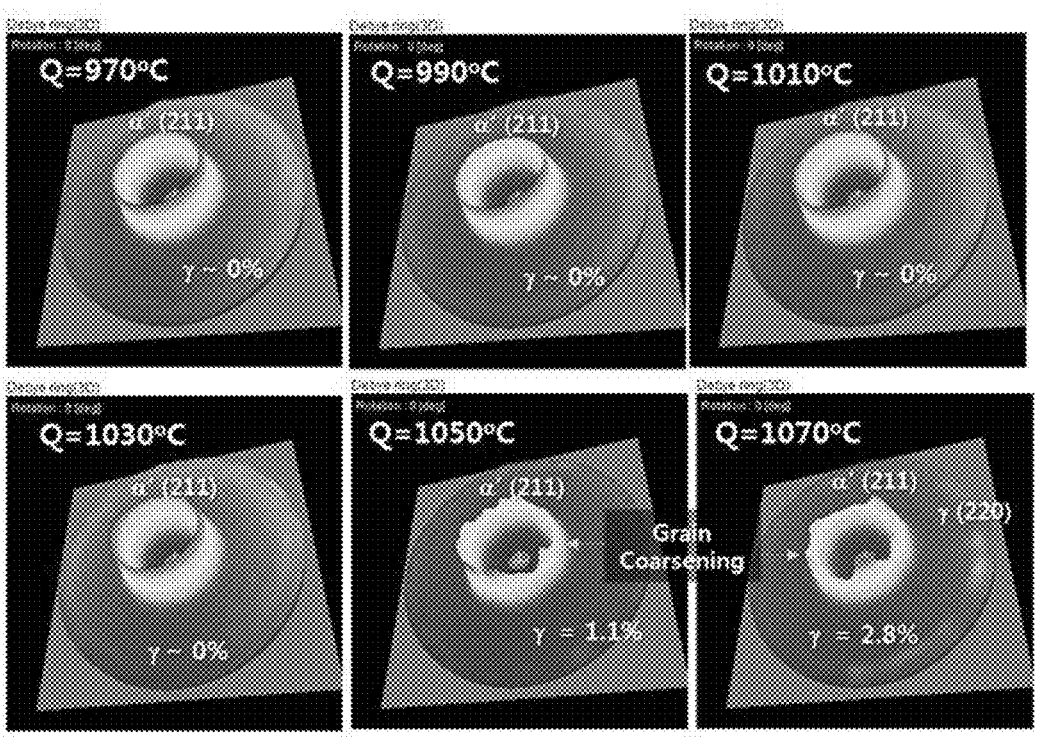
FIG. 5 is a series of images showing the results of measurement of the Debye rings depending on the quenching temperature using an X-ray diffractometer in Test Example 4.
Figure 6:
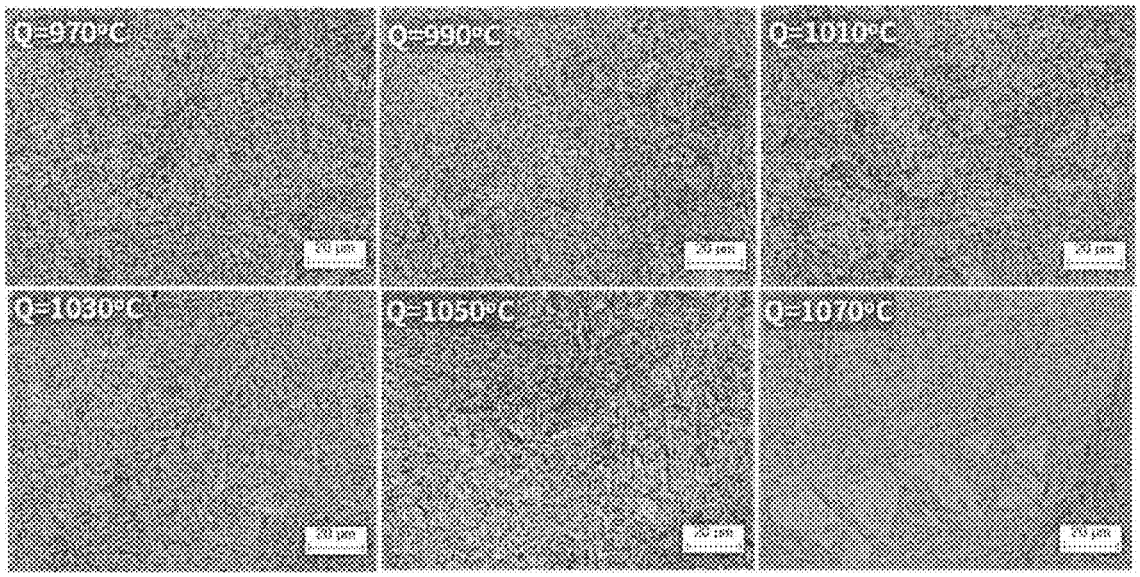
FIG. 6 is a series of optical images showing changes in structure depending on the quenching temperature in Test Example 4.
Figure 7:
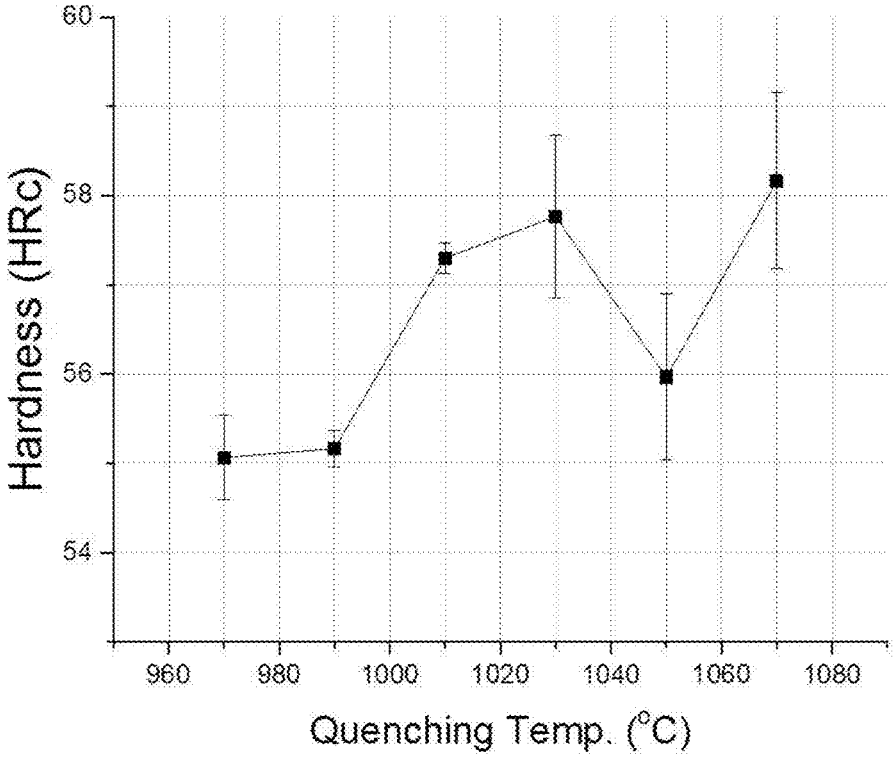
FIG. 7 is a graph showing the results of measurement of changes in hardness depending on the quenching temperature in Test Example 4.

Observation of Changes in Structure and Hardness Depending on Quenching Temperature Changes in the microstructure of the mold steel of Example 1 were measured at different quenching temperatures. The Debye ring images thereof using a two-dimensional meter are shown in FIG. 5 and the optical images thereof are shown in FIG. 6. The results of measurement of hardness depending on the quenching temperature are shown in FIG. 7.

FIG. 5 shows the X-ray diffraction images of Debye rings for martensite, which is the matrix of the mold steel. When the quenching temperature is 1050° C., the Debye ring shows a sharp shape, which is considered to be the result of abnormal grain growth of the grain with a specific orientation. Also, the Debye ring for residual austenite appears at 1050° C. or higher. When the quenching temperature is 1050° C. or higher, the structure may become non-uniform, as is apparent from FIG. 6. Consequently, in order to form a uniform structure, the quenching temperature is preferably set to less than 1050° C. Typically, as the quenching temperature is higher, the solubility of alloy elements is increased to thus exhibit high hardenability. However, as shown in FIG. 7, hardness is drastically increased at about 1000° C. and then drastically decreased at about 1040° C. Hence, in order to increase the hardness of the mold steel, quenching heat-treatment is preferably carried out at 1000 to 1040° C.

Test Example 5

Measurement of Hardness Depending on Tempering Temperature

Figure 8:
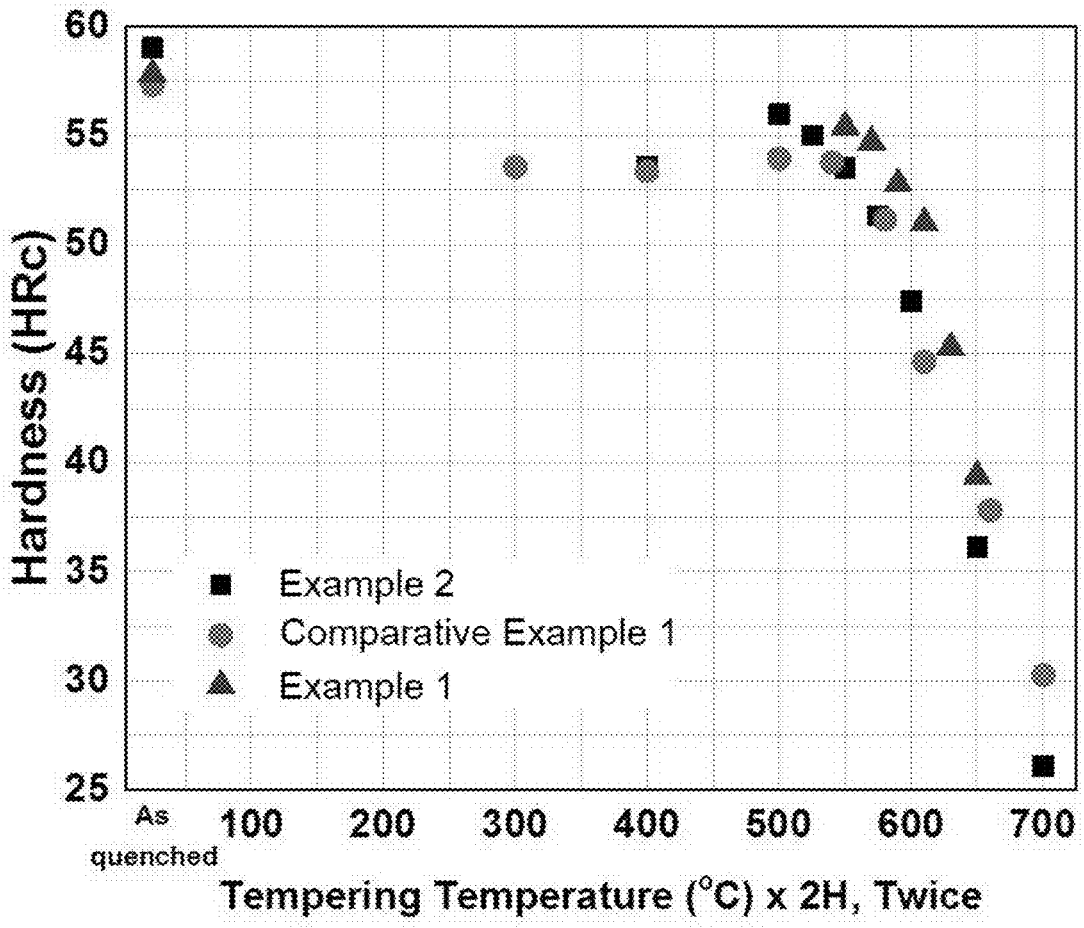
FIG. 8 is a graph showing the results of measurement of changes in hardness depending on the tempering temperature in Test Example 5.

The mold steels having the compositions of Examples 1 and 2 and Comparative Example 1 were manufactured as in Preparation Example, with the exception that two-stage tempering was performed by changing the temperature to fall within the temperature range of 300 to 700° C. The results are shown in FIG. 8. Here, the temperatures of individual stages in the tempering step were consistently adjusted.

As shown in FIG. 8, when the tempering temperature is 540° C. or less, hardness on the graph appears to be high, but actually there is a risk of tempering brittleness due to the secondary hardening. When the tempering temperature is higher than 630° C., a severe decrease in hardness can be confirmed to occur. Accordingly, the tempering process is preferably performed in the temperature range of 540 to 630° C., whereby a high hardness of 45 HRc or more can be obtained. Furthermore, hardness can be confirmed to be relatively higher in the above temperature range in Examples than in Comparative Example.

Test Example 6

Evaluation of Softening Resistance

Figure 9:
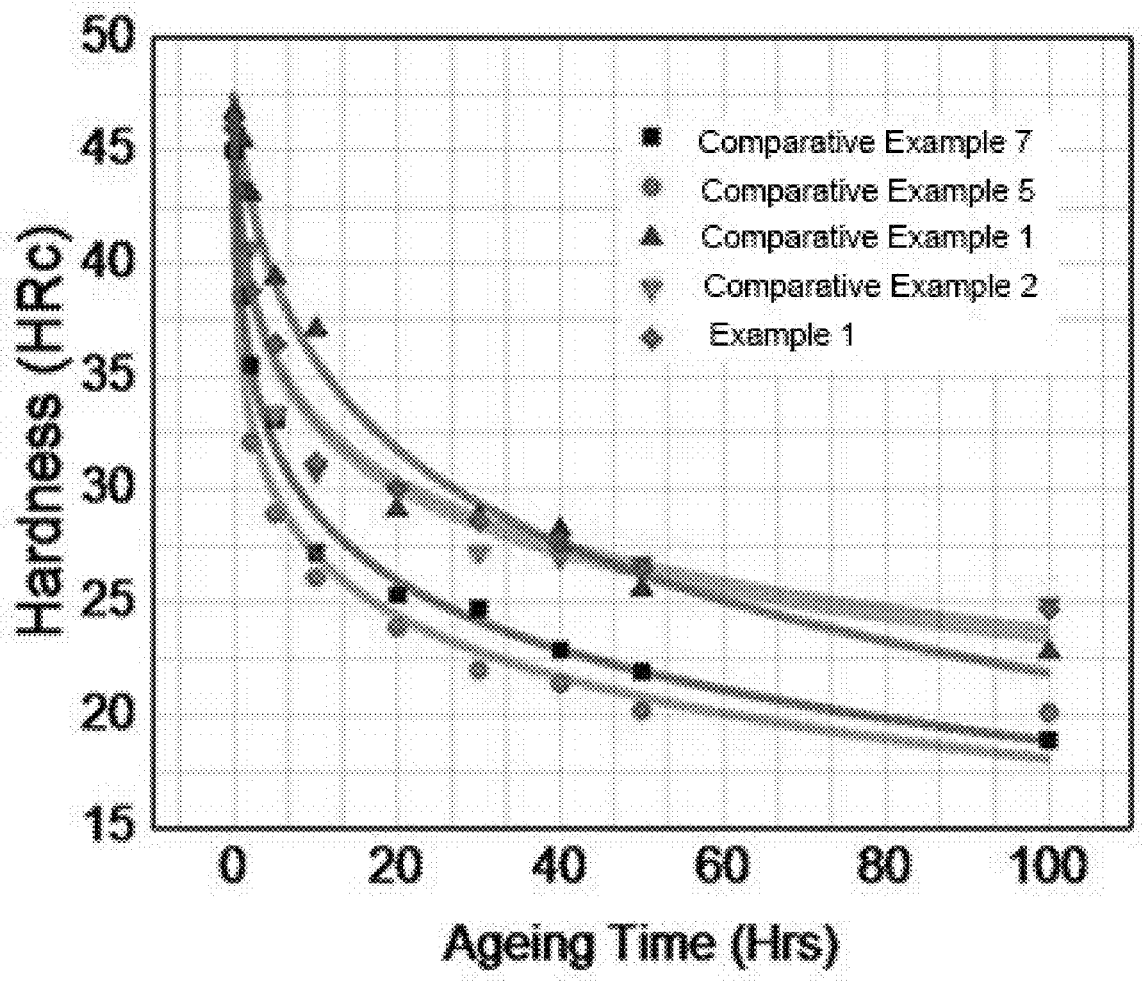
FIG. 9 is a graph showing the results of measurement of changes in hardness depending on the tempering time in Test Example 6.

In order to evaluate changes in hardness depending on the tempering time, hot-work mold steels of Example 1 and Comparative Examples 1, 2, 5 and 7 were manufactured in the same manner as in Preparation Example, with the exception that the tempering temperature was set to 650° C. and heat-treatment was conducted for 0.01, 1, 2, 5, 10, 20, 30, 40, 50 and 100 hr, followed by cooling. The results of measurement of hardness of individual test samples are shown in FIG. 9.

Based on the test results, initial hardness values were similar in individual mold steels, and after 100 hr, the decrease in hardness was the lowest in the mold steel of Example 1. Softening resistance, which is resistance to a decrease in hardness at a high temperature, is deemed to be in direct proportion to the amounts of molybdenum, titanium and niobium for forming a stable carbonitride, which can also be confirmed from the result in which the softening resistance of Comparative Example 2 having high molybdenum content was high.

Thus, in order to increase the softening resistance of the hot-work mold steel, molybdenum is preferably contained in an amount of 1.4 wt % or more.

Test Example 7

Evaluation of Nitriding Characteristics

Figure 10:
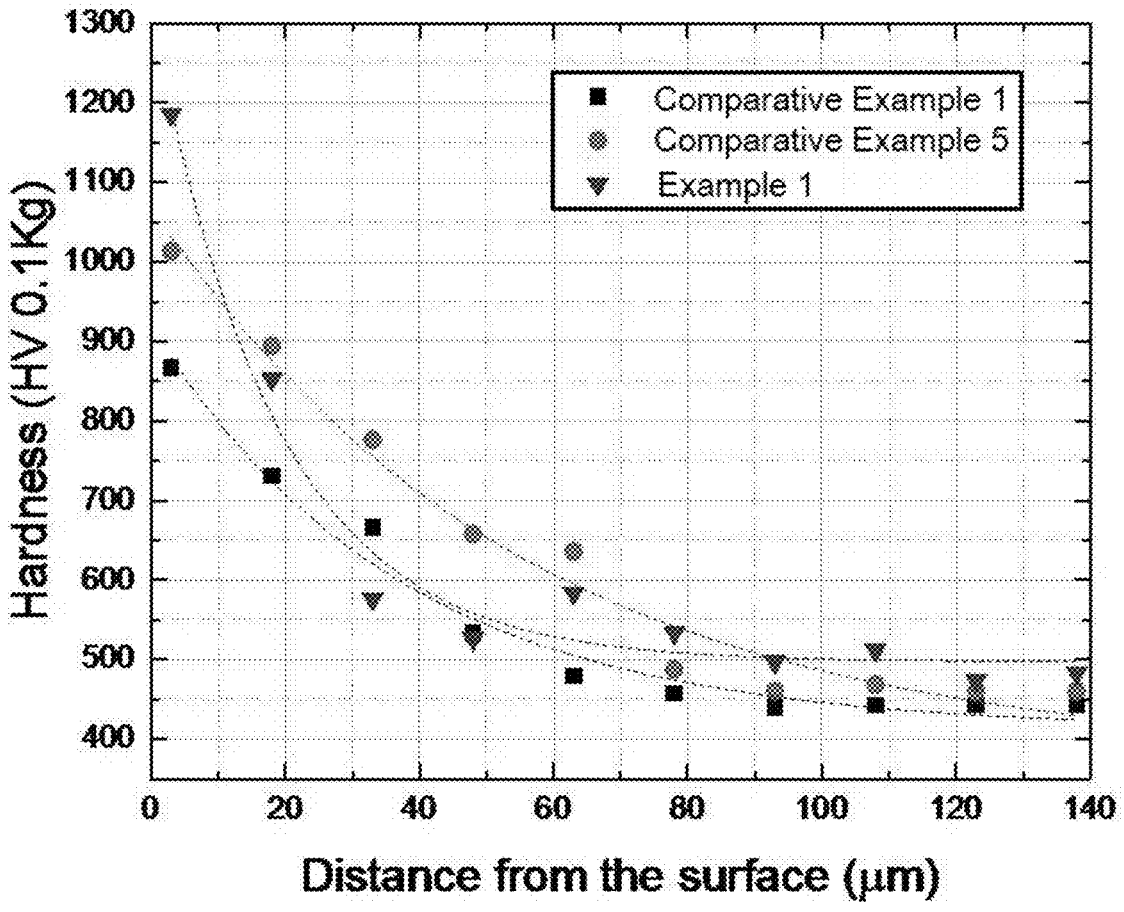
FIG. 10 is a graph showing hardness depending on the distance from the surface of mold steel after nitriding treatment in Test Example 7.

The hot-work mold steels of Example 1 and Comparative Examples 1 and 5 were subjected to surface treatment using gas nitrosulfurizing at 550° C. for 15 hr, after which the hardness was measured as a function of the distance from the surface thereof. The results are shown in FIG. 10.

Based on the test results, compared to the hardness of the matrix, surface hardness after nitriding was increased to 701 Hv in Example 1, and was increased to 425 Hv in Comparative Example 1 and 553 Hv in Comparative Example 5. The surface hardness of Example 1 was improved by about 25% or more compared to Comparative Examples.

This is due to the result in which the hot-work mold steel according to the present invention effectively delayed the propagation of heat-check cracks, from which it is predicted that the life cycle of the mold produced from the hot-work mold steel according to the present invention will be much longer than when using other mold steels.

The increase in hardness due to nitriding can be realized through molybdenum, chromium and vanadium, mainly molybdenum. In particular, when the amount of molybdenum is less than 1.4 wt %, the increase in hardness is significantly reduced. Hence, molybdenum is preferably contained in an amount of 1.4 wt % or more based on the total weight of the hot-work mold steel.

Test Example 8

Evaluation of Heat Check

Figure 11:
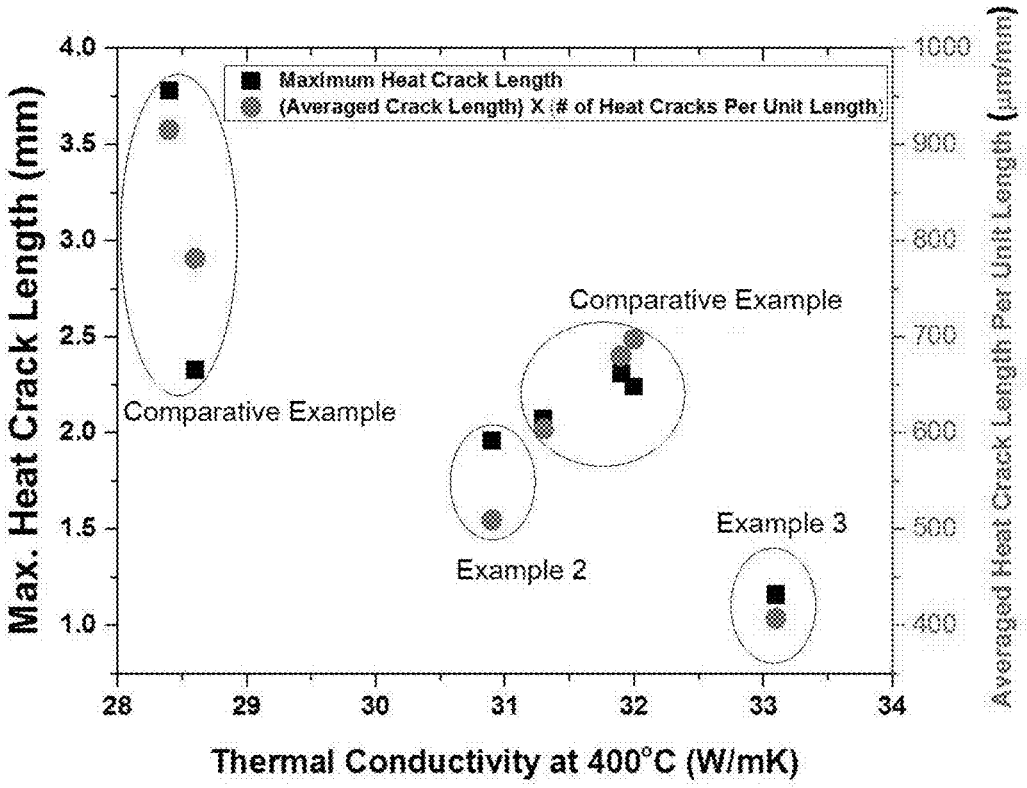
FIG. 11 is a graph showing the results of heat check depending on thermal conductivity in Test Example 8.

The mold steel samples of Examples 2 and 3 and Comparative Examples 1, 5 to 7 and 8 were repetitively subjected to 1000 cycles including heating to 650° C. in a high-frequency induction heating manner and then cooling to room temperature through water cooling, after which the number and length of heat cracks generated on the side of each sample were measured. The results are shown in Table 4 below. Also, the results of calculation of thermal conductivity of the samples using Equation 1 are shown in Table 4, and the maximum heat crack length depending on the thermal conductivity and the heat crack length per unit sample length are shown in FIG. 11.

TABLE 4

| Example | Value of Equation 1 (W/mK) | A: Average heat crack length (μm) | B: Number of heat cracks per unit sample length ($mm^{-1}$) | Maximum heat crack length (mm) | A × B: Average heat crack length per unit sample length (μm/mm) |
|---|---|---|---|---|---|
| Ex. 2 | 30.9 | 215 | 2.37 | 1.96 | 509.55 |
| Ex. 3 | 33.1 | 181 | 2.25 | 1.16 | 407.25 |
| Comp. Ex. 1 | 32.0 | 292 | 2.39 | 2.24 | 697.88 |
| Comp. Ex. 5 | 28.6 | 349 | 2.24 | 2.33 | 781.76 |
| Comp. Ex. 6 | 31.2 | 257 | 2.35 | 2.07 | 603.95 |

TABLE 4-continued

| Example | Value of Equation 1 (W/mK) | A: Average heat crack length (μm) | B: Number of heat cracks per unit sample length ($mm^{-1}$) | Maximum heat crack length (mm) | A × B: Average heat crack length per unit sample length (μm/mm) |
|---|---|---|---|---|---|
| Comp. Ex. 7 | 28.4 | 460 | 1.99 | 3.78 | 915.40 |
| Comp. Ex. 8 | 31.9 | 321 | 2.12 | 2.31 | 680.52 |

Based on the test results, the numbers of heat cracks per unit sample length were similar in Examples and Comparative Examples, but the average heat crack length was remarkably short in Examples, and the heat crack length per unit sample length was much lower in Examples than in Comparative Examples, whereby the heat crack resistance of the hot-work mold steel of Examples was excellent. When the mold steel of the present invention is used, a mold having a prolonged life cycle can be concluded to result compared to when using conventional mold steel.

As shown in FIG. 11, as the thermal conductivity was higher, the maximum heat crack length and the average heat crack length times (x) the number of heat cracks per unit sample length were decreased. In particular, when the thermal conductivity calculated using Equation 1 is 30.5 W/mK or more, heat crack resistance is remarkably increased. Hence, it is preferred that the thermal conductivity of the hot-work mold steel calculated using Equation 1 be 30.5 W/mK or more.

As such, the thermal conductivity of Comparative Examples 1, 6 and 8 was 30.5 W/mK or more, and thus heat crack resistance was superior compared to Comparative Examples 5 and 7, but was very low compared to Examples 2 and 3. This shows that in order to increase heat crack resistance, not only Equation 1 but also the composition limited in the present invention and Equation 2 should be satisfied, as will be apparent from Test Example 10 below.

Test Example 9

Evaluation of Melt-Out

The mold steel of each of Examples 2 and 3 and Comparative Examples 1, 5 and 7 was manufactured into a test sample having a size of 20×20×10 mm, after which an adhesive refractory material was applied only on one surface of each sample and sufficiently dried for 48 hr or more. Then, the sample was immersed for 43 hr in the melt in which the temperature of molten aluminum was 700° C., taken out of the melt, cooled, and cut in a direction perpendicular to the surface on which the refractory material was applied, and the cross-section thereof was observed using an optical microscope. The results are shown in FIG. 12.

Figure 13:
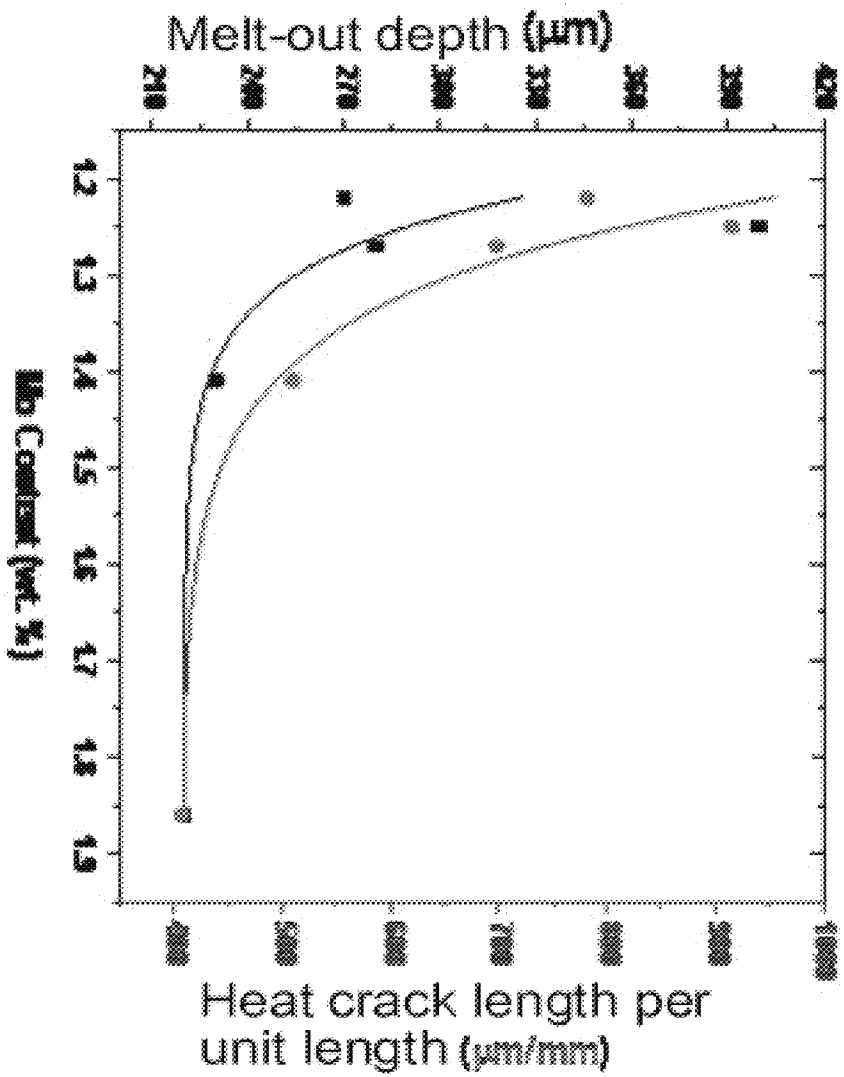
FIG. 13 is a graph showing the melt-out depth depending on the amount of molybdenum in Test Example 9.

Then, the average value of the melt-out depth, measured ten times from the point where melt-out occurred because the refractory material was not applied, was determined. The results are shown in FIG. 13, along with the heat crack length per unit sample length obtained in Test Example 8. The X-axis of the graph designates the molybdenum content, and the melt-out values show the values of Comparative Examples 5, 7, 1 and Examples 2 and 3, respectively, in the sequence in which the amount of molybdenum is increased. Here, the square-icon data points indicate melt-out depth, and the circular-icon data points indicate heat crack length per unit sample length.

Figure 12:
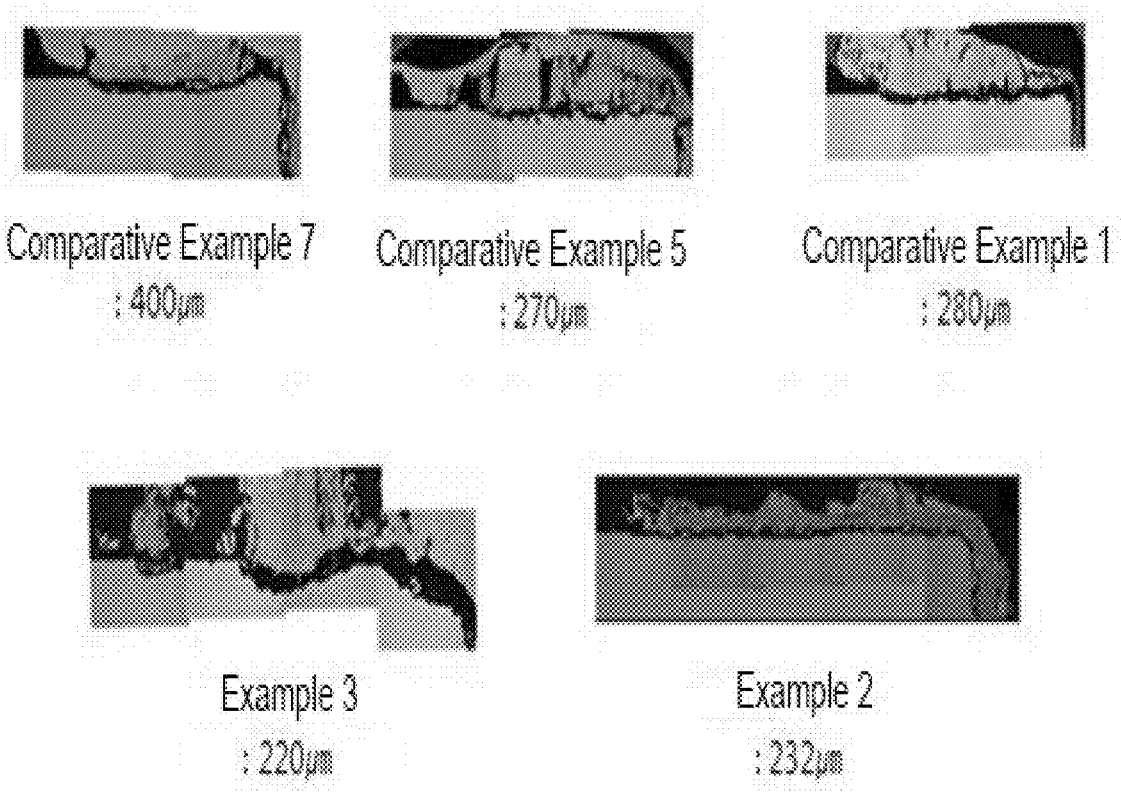
FIG. 12 is a series of images showing the results of melt-out test in Test Example 9.

As shown in FIG. 12, based on the results of evaluation of melt-out, the melt-out depth was 270 μm or more in Comparative Examples, whereas the melt-out depth was less than about 230 μm in Examples, whereby the melt-out characteristics of Examples were superior compared to Comparative Examples. As shown in FIG. 13, such melt-out characteristics can be confirmed to be in proportion to the amount of molybdenum.

Based on the test results, the amount of molybdenum in the hot-work mold steel according to the present invention is limited to 1.4 wt % or more, and thus the stable carbide formed upon secondary hardening of the mold steel is increased in the amount thereof and is uniformly distributed, thus increasing melt-out resistance.

Test Example 10

In order to confirm that alloy performance is improved when the alloy composition limitations (comp.) of the present invention and both equations (Eq. 1 and Eq. 2) are all satisfied, the samples of Examples and Comparative Examples were measured for average heat crack length and the number of heat cracks per unit length. The results are summarized in Table 5 below, wherein, for each sample, whether any or all of the above three conditions are satisfied is indicated by an "X" (satisfied) or an "O" (not satisfied).

TABLE 5

| Example | Comp. | Eq. 1 | Eq. 2 | A: Average heat crack length (μm) | B: Number of heat cracks per unit sample length ($mm^{-1}$) | Maximum heat crack length (mm) | A × B: Average heat crack length per unit sample length (μm/mm) |
|---|---|---|---|---|---|---|---|
| Ex. 2 | ○ | ○ | ○ | 215 | 2.37 | 1.96 | 509.55 |
| Ex. 3 | ○ | ○ | ○ | 181 | 2.25 | 1.16 | 407.25 |
| Comp. Ex. 1 | X | ○ | X | 292 | 2.39 | 2.24 | 697.88 |
| Comp. Ex. 5 | X | X | X | 349 | 2.24 | 2.33 | 781.76 |
| Comp. Ex. 6 | X | ○ | X | 257 | 2.35 | 2.07 | 603.95 |
| Comp. Ex. 7 | X | X | X | 460 | 1.99 | 3.78 | 915.40 |
| Comp. Ex. 8 | ○ | ○ | X | 321 | 2.12 | 2.31 | 680.52 |

Based on the measurement results, the hot-work mold steel samples that did not satisfy at least one of the composition of the hot-work mold steel, Equation 1, and Equation 2 were remarkably decreased in heat crack resistance.

In particular, when comparing Examples satisfying all conditions with Comparative Examples not satisfying at least one of the conditions, heat crack resistance was increased by a minimum of 20% to a maximum of 120% in Examples compared to Comparative Examples.

Specifically, the hot-work mold steel comprising, as alloy elements, carbon, silicon, manganese, chromium, molybdenum, titanium, vanadium, boron and aluminum, satisfies all of the composition limited in the present invention, Equation 1 regarding thermal conductivity and Equation 2 regarding hardenability, thereby remarkably increasing heat crack resistance.

Thus, when all three conditions are satisfied, to include the present invention's composition limitations, Equation 1, and Equation 2, the hot-work mold steel can exhibit improved heat crack resistance and mechanical properties. In addition, the mold produced using such hot-work mold steel can have a long life cycle and simultaneously can exhibit improved mold performance.

Moreover, the hot-work mold steel manifests superior nitriding characteristics. Thus, when additional nitriding heat-treatment is performed, further improved heat crack resistance and mechanical properties can be expected to result.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hot-work mold steel comprising 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), 0.001 to 0.007 wt % of tungsten (W), and a remainder of iron (Fe) and impurities, wherein the wt % values satisfy $$28.15-3.68Si-1.60Mn+51.22C-1.11Cr-2.18Ti-1.72V-413.6B-53.78C^2+93012B^2\geq 30.5$$

and $$10^{(3.389-0.6045Si-0.4541Mn-1.803C-0.3361Cr-0.5689Mo+0.581Ti+0.2902V-700.6B+115955B^2)}\leq 0.35$$

and are based on a total weight of the hot-work mold steel.

2. The hot-work mold steel of claim 1, further comprising 0.001 to 0.025 wt % of niobium (Nb).

3. The hot-work mold steel of claim 1, further comprising 0.005 to 0.022 wt % of cobalt (Co).

4. The hot-work mold steel of claim 1, wherein the hot-work mold steel is a mold steel for die casting, obtained through a quenching step and a tempering step.

5. The hot-work mold steel of claim 4, wherein the quenching step is performed in a temperature range of 1000 to 1040° C., and the tempering step is performed in a temperature range of 520 to 640° C.

6. A hot-work mold steel comprising 0.37 to 0.46 wt % of carbon (C), 0.25 to 0.5 wt % of silicon (Si), 0.36 to 0.56 wt % of manganese (Mn), 2.0 to 5.0 wt % of chromium (Cr), 1.4 to 2.6 wt % of molybdenum (Mo), 0.4 to 0.8 wt % of vanadium (V), 0.0007 to 0.004 wt % of boron (B), 0.002 to 0.022 wt % of aluminum (Al), 0.001 to 0.09 wt % of titanium (Ti), 0.005 to 0.022 wt % of cobalt (Co), and a remainder of iron (Fe) and impurities, wherein the wt % values satisfy $$28.15-3.68Si-1.60Mn+51.22C-1.11Cr-2.18Ti-1.72V-413.6B-53.78C^2+93012B^2\geq 30.5$$

and $$10^{(3.389-0.6045Si-0.4541Mn-1.803C-0.3361Cr-0.5689Mo+0.581Ti+0.2902V-700.6B+115955B^2)}\leq 0.35$$

and are based on a total weight of the hot-work mold steel.

* * * * *